US009840835B2

(12) United States Patent
Niroumand

(10) Patent No.: US 9,840,835 B2
(45) Date of Patent: Dec. 12, 2017

(54) TEMPORARY DRAINAGE WELLS IN LOOSE GRANULAR SOILS

(71) Applicant: Bahman Niroumand, Boushehr (IR)

(72) Inventor: Bahman Niroumand, Boushehr (IR)

( * ) Notice: Subject to any disclaimer, the term of this patent is extended or adjusted under 35 U.S.C. 154(b) by 0 days.

(21) Appl. No.: 15/061,138

(22) Filed: Mar. 4, 2016

(65) Prior Publication Data

US 2016/0186398 A1 Jun. 30, 2016

(30) Foreign Application Priority Data

Mar. 4, 2015 (IR) ..... 139350140003013533

(51) Int. Cl.
*E02D 3/10* (2006.01)
*E03F 1/00* (2006.01)
*E02D 1/00* (2006.01)

(52) U.S. Cl.
CPC ..... *E03F 1/002* (2013.01); *E02D 1/00* (2013.01); *E02D 3/10* (2013.01)

(58) Field of Classification Search
CPC ..... E02D 3/10
USPC ..... 405/36, 43–45, 49, 50, 231–233, 235, 405/236, 243, 245, 249, 257
See application file for complete search history.

(56) References Cited

U.S. PATENT DOCUMENTS 191,876 A * 6/1877 Mesler ..... E02B 11/005 175/314
790,910 A * 5/1905 McClintock ..... E02D 7/30 111/7.1
951,668 A * 3/1910 Welsh ..... E02D 5/385 405/243
2,326,155 A * 8/1943 McCook ..... E02D 5/38 405/243
2,636,355 A * 4/1953 Thornley ..... E02D 5/385 173/128
3,839,874 A * 10/1974 Wyant ..... E02D 5/38 405/233
4,623,025 A * 11/1986 Verstraeten ..... E02D 5/62 175/171
4,934,865 A 6/1990 Varkonyi

FOREIGN PATENT DOCUMENTS

CN 101250879 A 8/2008
CN 101627675 A 1/2010
JP 56-81719 A * 7/1981
JP 61113920 A * 5/1986

* cited by examiner

*Primary Examiner* — Sunil Singh
(74) *Attorney, Agent, or Firm* — NovoTechIP International PLLC

(57) ABSTRACT

A method for building a drainage well in a loose granular soil is disclosed. The method includes inserting a liner tube into a loose soil using an inserting device. The liner tube includes a housing and an internal shaft placed inside the housing and coupled to inside the housing via a locking mechanism. Subsequent to insertion into the soil, the internal shaft is unlocked from the housing and removed therefrom. Thereafter, a grooved pipe is inserted inside the housing using the inserting device. Subsequent to the grooved pipe insertion into the housing, the housing is removed from the loose granular soil using a mechanical excavator and a space between the loose granular soil and the grooved pipe is filled with a filling material.

9 Claims, 12 Drawing Sheets

TEMPORARY DRAINAGE WELLS IN LOOSE GRANULAR SOILS

CROSS REFERENCE TO RELATED APPLICATION

This application claims the benefit of priority to an Iran patent application having Ser. No. 139350140003013533, filed on Mar. 4, 2015, which subsequently issued as Iran patent number 86823 on Sep. 30, 2015, the entire content of which is incorporated by reference herein.

TECHNICAL FIELD

The present application relates generally to providing water drainage wells and, more particularly, to providing temporary water drainage wells to drain water from loose granular soil at construction sites such that the drainage wells can be easily installed while preventing slippage and collapsing of the soil.

BACKGROUND

Construction projects typically require drainage and removal of groundwater at the construction site prior to excavation. Groundwater drainage is typically via installing drainage wells in various locations within the construction site and pumping the drained groundwater out from the wells. However, installation of drainage wells, especially in loose granular soils, can be a challenging process. This is because loose granular soils are unstable and there is a high possibility of soil slippage and loss of soil mass during the drainage process.

Currently known techniques for installing drainage well pipes have multiple disadvantages such as, for example, limited depth of the wells, need for considerably massive excavation, soil slippage, requiring high volumes of aggregate material for protection of well walls, slow installation process, high cost, and need for removal of soil inside the well when casing pipes are used. In cases where the soil inside the drainage well is removed while removing the groundwater, piping phenomenon may occur which may cause the soil beneath the well to sink.

Hence, a need exists for providing temporary water drainage wells to drain water from loose granular soil at construction sites such that the drainage wells can be easily installed while preventing slippage and collapsing of the soil.

SUMMARY

In one general aspect, the instant application describes a method for building a drainage well in a loose granular soil. The method includes steps of inserting a liner tube into a loose soil using an inserting device, the liner tube including a housing and an internal shaft placed inside the housing and coupled to inside the housing via a locking mechanism; unlocking the internal shaft from the housing and removing the unlocked internal shaft from the housing subsequent to inserting the liner tube into the loose soil; and inserting via an inserting device a grooved pipe inside the housing from which the internal shaft has been removed. The grooved pipe is longer than the housing and is configured to receive groundwater via a plurality of grooves within the grooved pipe. The method further includes steps of removing via a mechanical excavator the housing from the loose granular soil subsequent to insertion of the grooved pipe inside the housing and filling a space between the loose granular soil and the grooved pipe with a filling material.

The above general aspect may include one or more of the following features. The inserting device may include a mechanical hammer for hammering the liner tube into the loose granular soil. The liner tube may include a cone shaped end. The method may further include steps of inserting a drainage pipe inside the grooved pipe and connecting the drainage pipe to a pump to remove the groundwater penetrated inside the grooved pipe.

Removing the unlocked internal shaft may include removing the unlocked internal shaft using the mechanical excavator. The inserting device may include a hydraulic hammer, a mechanical auger, or a compressed air hammer. The cone shaped end of the liner tube is part of the internal shaft and is configured to facilitate penetration of the liner tube into the loose soil. The filling material may include sand. The method may further include filling up to 50 centimeters from bottom of the grooved pipe with sand to stabilize the grooved pipe inside the liner tube.

The drainage well may be about 7 meters deep and about 50 centimeters wide. The top part and a bottom part of the liner tube may be covered with hard steel plates to increase the liner tube strength. Inserting the liner tube in the soil may be performed without soil removal, and wherein the liner tube may compress the loose soil when entering the soil. The compressed soil around the liner tube may prevent occurrence of piping phenomena. The inserting device may include a mechanical hammer, and inserting the line tube may include inserting the line tube into the soil using a flat disk attached to the mechanical hammer. The liner tube may be connected to the mechanical hammer via steel cables. The grooved pipe may be made from hard plastic, hard polymer, polyethylene, polyvinyl chloride (PVC), or hard un-plasticized polyvinyl chloride (UPVC). The method may further include a step of wrapping the grooved pipe with a geotextile layer configured to protect the grooved pipe and filter the groundwater penetrating the grooved pipe.

In another general aspect, the instant application describes another method for draining groundwater from an area having loose granular soil. This method includes steps of creating a plurality of drainage wells in the area of the loose granular soil. The drainage wells may have a predefined distance from each other and creating each drainage well may include hammering a liner tube with a cone shaped end into the loose soil using a mechanical hammer. The liner tube may include a housing and an internal shaft placed inside the housing and fixed to the housing using a locking mechanism. Creating each drainage well may further include steps of unlocking the internal shaft from the housing and removing the unlocked internal shaft from inside the housing subsequent to hammering the liner tube into the loose soil. Creating each drainage well may further include a step of inserting a grooved pipe inside the housing by hammering the grooved pipe using the mechanical hammer. The grooved pipe is longer than the housing and is configured to receive groundwater via a plurality of grooves within the grooved pipe. Creating each drainage well may further include steps of filling bottom of the grooved pipe with sand to stabilize the grooved pipe inside the housing; removing the housing from the loose granular soil using a mechanical excavator, and filling a space created by the removing of the housing with a filling material. The method may further include steps of inserting a drainage pipe inside the grooved pipe of each drainage well from the plurality of drainage wells; and connecting the drainage pipes from the plurality of drainage wells to a pump configured to remove the groundwater penetrated inside the grooved pipes of the plurality of drainage wells.

The above general aspect may include one or more of the following features. For example, removing of the unlocked internal shaft may be performed using the mechanical excavator. The mechanical hammer may be a hydraulic hammer. The cone shaped end of the liner tube may be connected to the internal shaft. The hammering the liner tube in the soil may be performed without soil removal. The liner tube may compress the loose soil when entering the soil. The liner tube may be connected to the mechanical hammer via steel cables.

BRIEF DESCRIPTION OF THE DRAWINGS

Features of the subject technology are set forth in the appended claims. However, for purpose of explanation, several implementations of the subject technology are set forth in the following figures.

DETAILED DESCRIPTION

Figure 1:
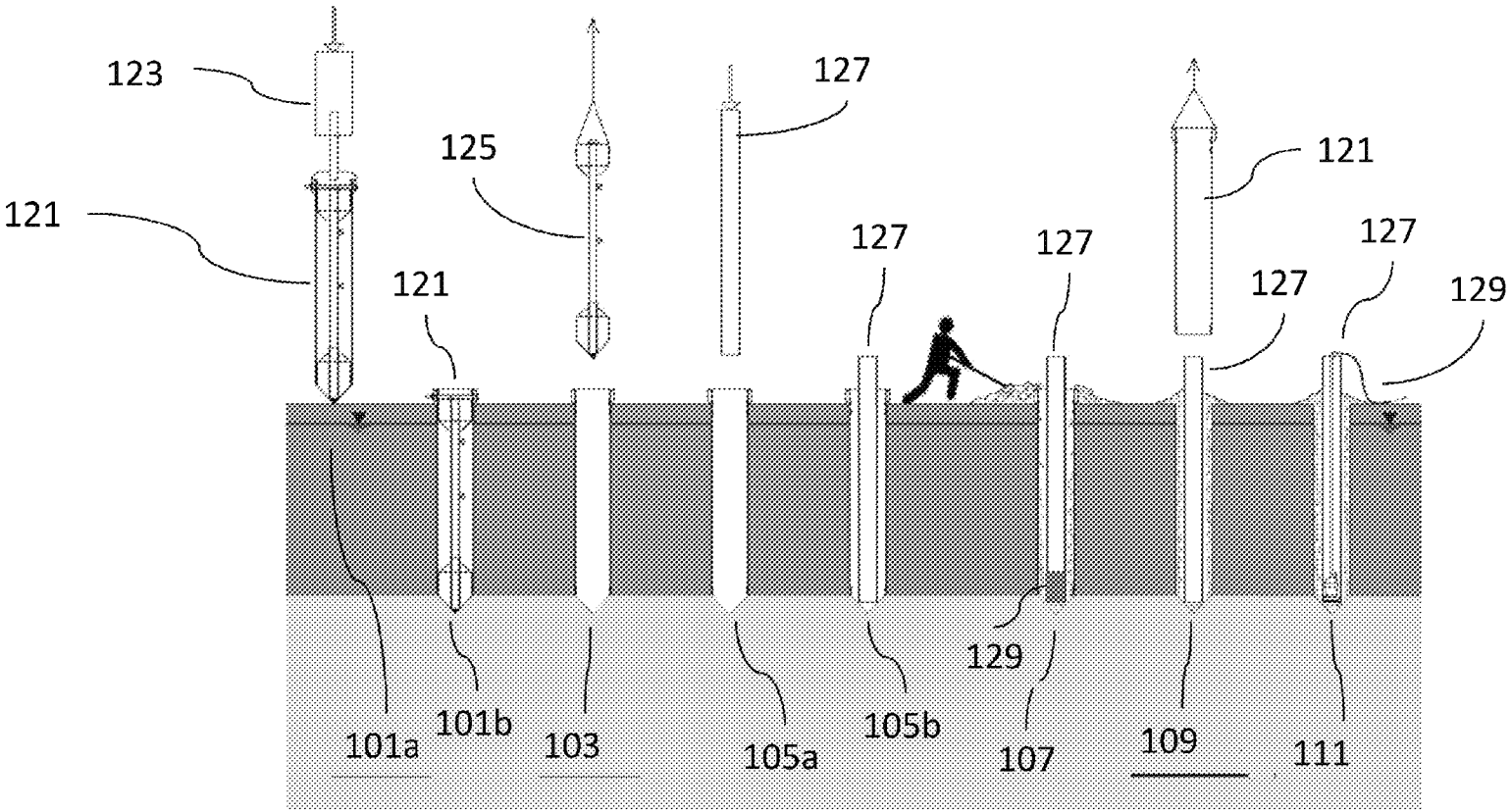
FIGS. 1 and 2 illustrate schematic views of steps for building temporary drainage wells in loose and submerged or saturated soil, according to an implementation.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or equipment have been described at a relatively high-level, without detail, in order to avoid unnecessarily obscuring aspects of the present teachings.

Since ancient times human beings have been trying to access groundwater (e.g., water present beneath earth's surface in soil pore spaces and in the fractures of rock formations) and find ways to construct building structures at or under the groundwater level. Various technologies have been developed for drilling drainage wells for extracting groundwater. Today, with advances in technology and the use of advanced equipment, drilling in difficult circumstances is possible. However, parameters such as technical, economic, environmental, speed and time, availability of equipment, have crucial effects on groundwater drainage process. In practice, drilling in hard soil formations is easier than drilling in loose soil formations, especially in the groundwater level. In loose granular soils saturated with water, drilling without using liner tubes or Bentonite mud is not possible. However, the use of bentonite mud in drainage wells is not customary due to significant reduction in permeability of the wall and bottom of the drainage well.

In development projects and urban construction, especially in areas with high levels of groundwater, traditional drainage methods are not effective. Some of the techniques currently used in constructing drainage wells in loose and saturated soil formations include, manual drilling, using excavators, using bucket type or screw type mechanical augers without installing liner tubes such that the soil is repeatedly removed, installing liner tubes and removing the soil inside the liner tube using a crew or bucket mechanical auger.

The traditional method of manual drilling is limited, especially in loose granular soils. In this method the depth of the drainage well cannot be deeper than the groundwater level and water drainage is hard. In some cases, the soil can be removed using excavators and cement, plastic, or metal grid liner pipes can be installed in the excavated area. However, this method is not suitable for areas with loose soil where the groundwater level is high. This is because a high volume of wet soil needs to be removed, a high volume of sand needs to be used to stabilize the liner pipes, and slippage and sinking of the soil around the liner pipe may occur that can damage the nearby buildings and structures.

The use of bucket type or screw type mechanical augers without installing liner tubes, for drilling drainage wells may need excavation of large pits in the ground. In addition, removal of the auger may cause soil slippage and a high volume of soil may be slipped in the excavation pit that should be removed. As a result deep drainage may not be possible. In addition piping phenomena may occur at the bottom of the drainage well. The piping phenomena includes occurrence of erosion and flooding that may damage the soil and the structures in the ground.

The installation of liner tubes in the soil and removing the soil inside the liner tube using a screw or bucket mechanical auger, may have disadvantages. For example, due to looseness of the soil around the liner tube, removal of loose and wet soil from inside the liner tube by using an auger can be very difficult because the liner may slip in the loose soil and move with the movements of the auger. In addition, the piping phenomena may occur at the bottom of the liner tubes. Since the soil inside the liner tubes need to be removed, and groundwater may enter the liner tubes with a high speed, the excavation and installation of drainage wells has to be performed with a high speed. Therefore, method and equipment are needed for installation of drainage wells in loose granular soils such that the disadvantages of the current methods can be resolved.

Figure 2:
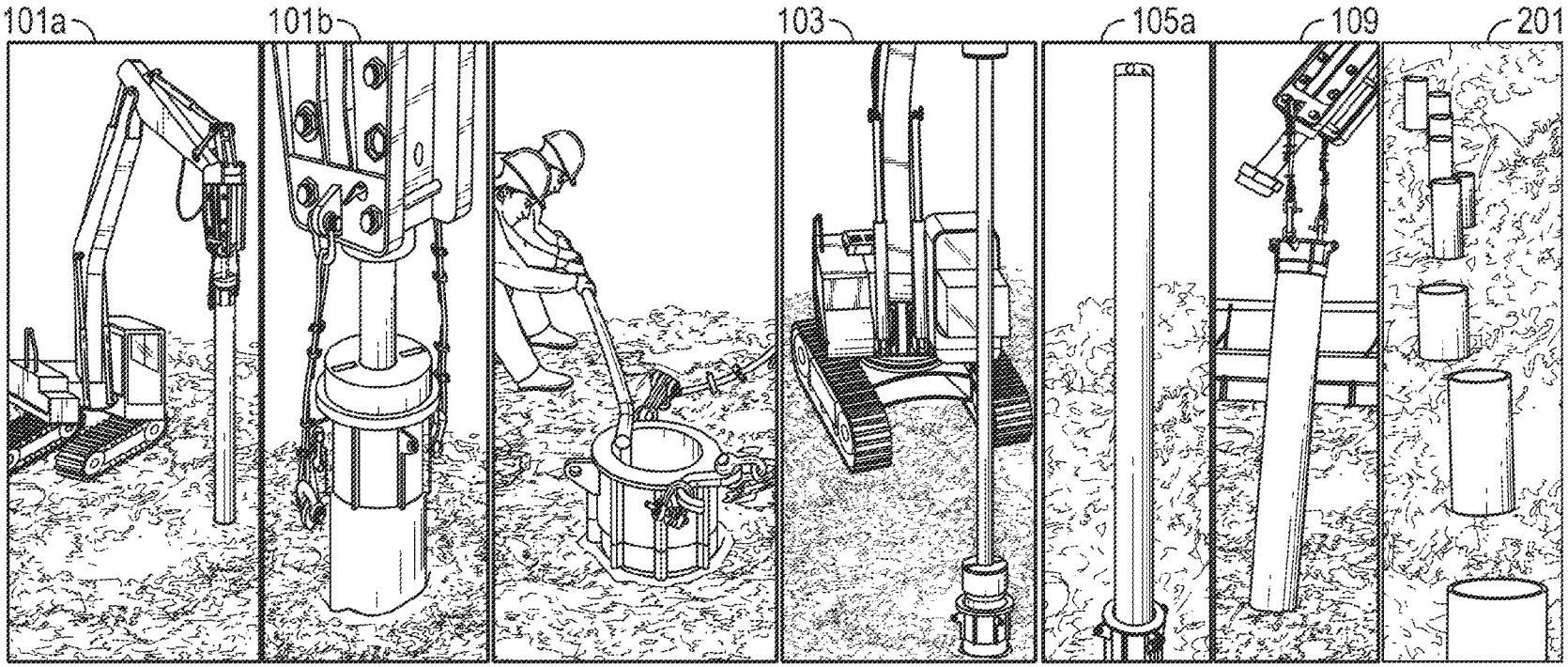
Figure 3:
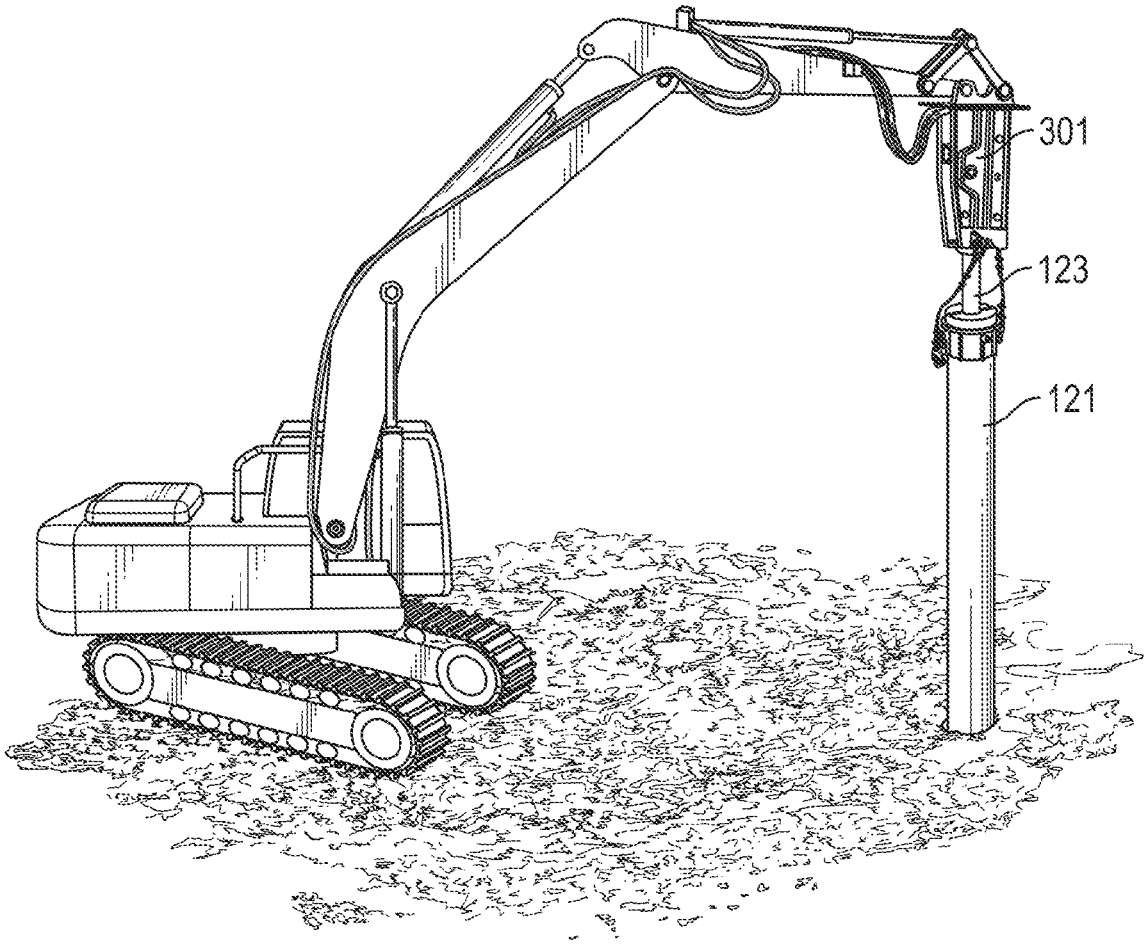
FIG. 3 illustrates a liner tube that is being hammered inside the soil by a mechanical hammer, according to an implementation.

Reference now is made in detail to the examples illustrated in the accompanying drawings and discussed below. FIGS. 1 and 2 illustrate schematic views of steps for building temporary drainage wells in loose and submerged or saturated soil, according to an implementation. At step 101*a* a liner tube 121 (e.g. a shuttle system) having a cone shaped end is being hammered into the soil. The liner tube 121 can be open on both ends having a cone shaped shaft 125 placed inside. The liner tube 121 can be, for example, hammered using a mechanical auger, a hydraulic hammer, or a compressed air hammer 123 installed on a mechanical excavator 301, as shown in FIG. 3. At step 101*b* the liner tuber 121 is completely hammered into the soil. The liner tube 121 when hammered in the soil creates a drainage pipe with desired depth and diameter. For example, the depth of the drainage pipe can be 7 meters and the diameter of the drainage pipe can be 50 centimeters. The depth and diameter of the drainage pipe may depend on various factor such as the soil type, the soil saturation amount, etc. The liner tube 121 is hammered in the soil by force from the hydraulic hammer 123 and as a result there is no need for removing any soil from the drainage well. In addition, the liner tube 121 compresses the soil around it when entering the ground and the pressed soil can become more stable than the original loose soil and the possibility of occurrence of piping phenomena and instability of the liner tube 121 can be reduced.

Figure 4:
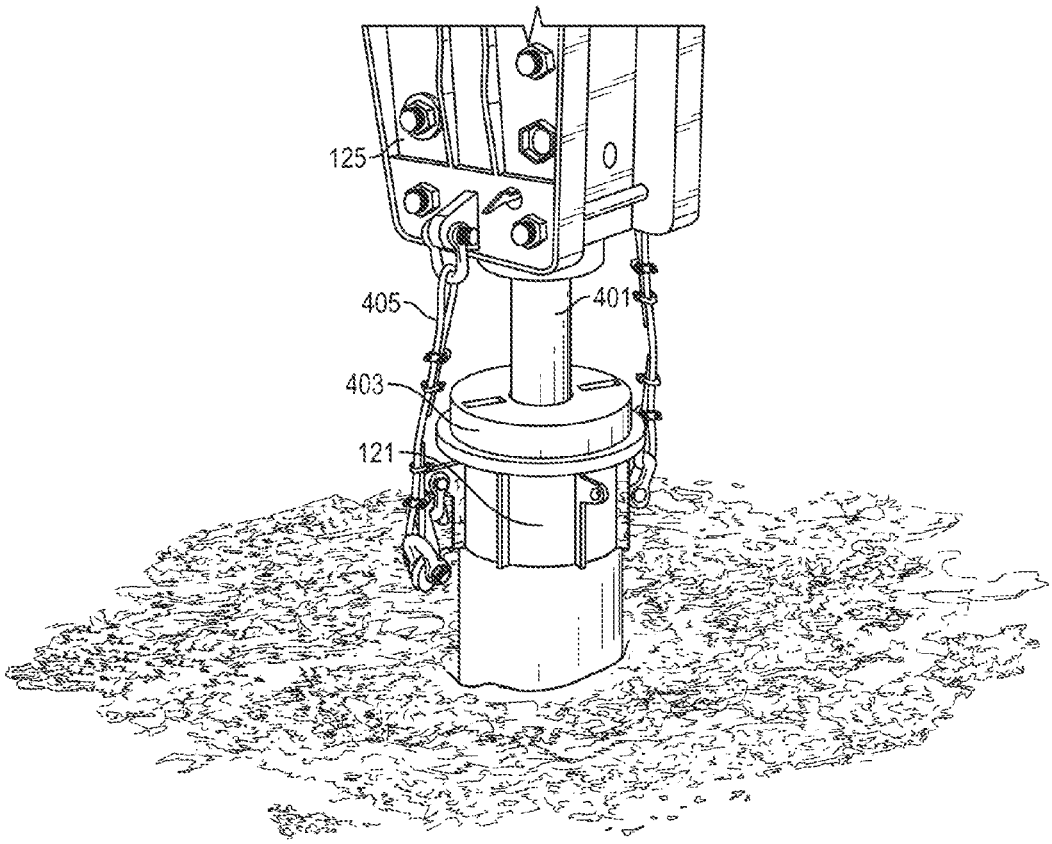
FIG. 4 illustrates a hydraulic hammer for hammering the liner tube into the soil, according to an implementation.

The poundings of the hydraulic hammer 123 can be transferred to the liner tube 121 by a shaft 401 (shown in FIG. 4) attached to a flat disk 403 specifically designed for the purpose of hammering the liner tube 121. The chains 405 shown in FIG. 4 can be steel cables with locks connected to the hydraulic hammer 123 at one end and to the internal shaft 125 at another end. The steel cables 405 can be later used by the mechanical excavator 301 to pull up and remove the liner tube 121. Specifically, the steel cables 405 can be later used by the mechanical excavator 301 to pull up and remove the internal shaft 125 from the liner tube 121.

Figure 5:
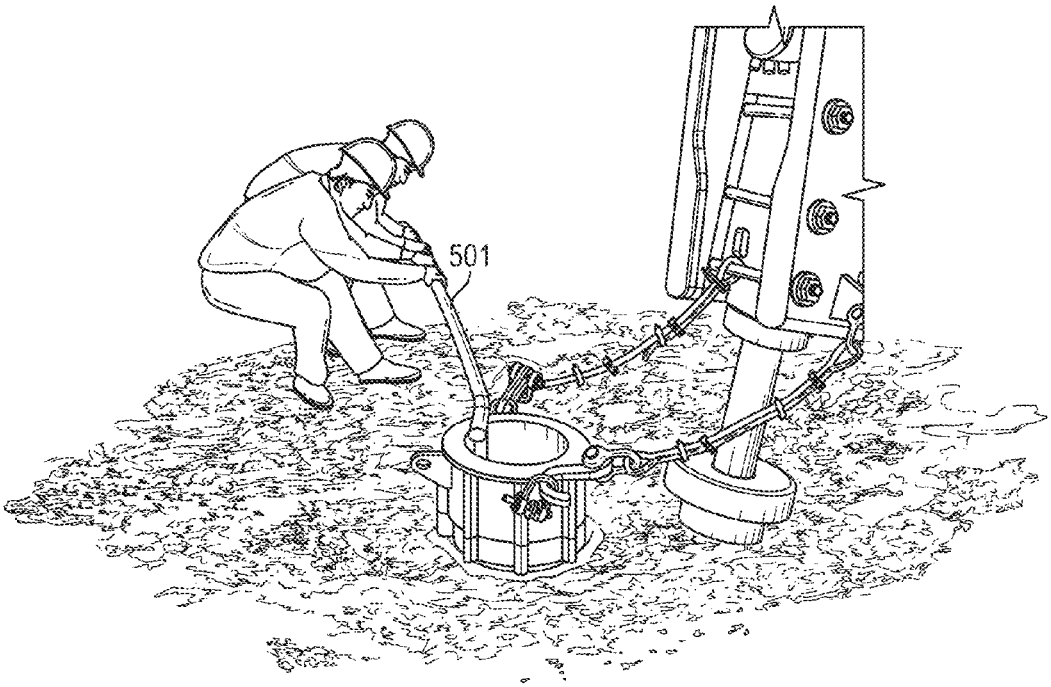
FIG. 5 illustrates opening a lock attached to the shaft within the liner tube, according to an implementation.
Figure 6:
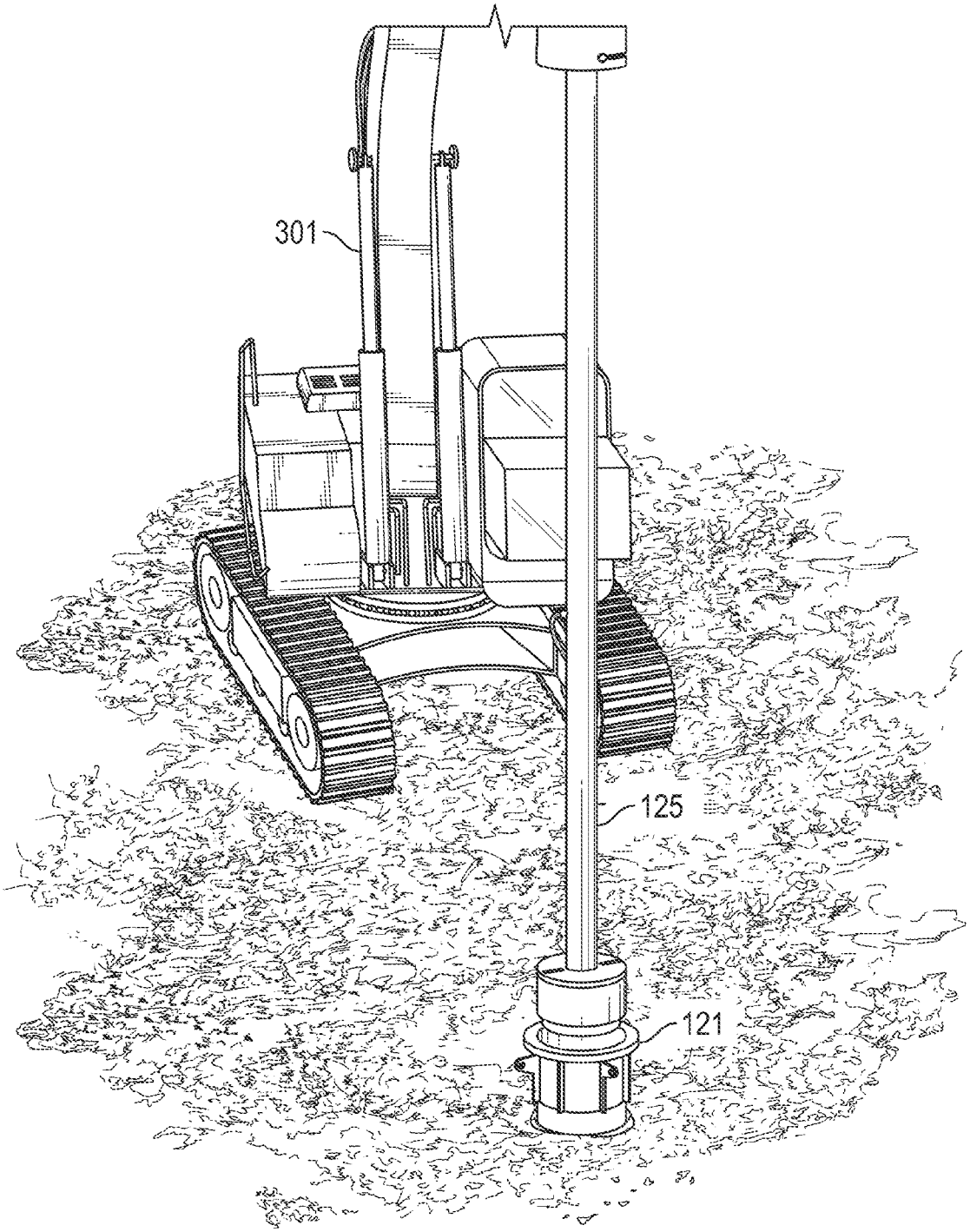
FIG. 6 illustrates removal of the shaft within the liner tube, according to an implementation.

The internal shaft 125 can have a cone shaped end enabling the liner tube 121 to be easily hammered down in the soil. The internal shaft 125 can be locked inside the liner tube 121 to prevent it from slipping. At step 103, the internal shaft 125 can be unlocked and removed from inside of the liner tube 121. FIG. 5 illustrates unlocking the internal shaft 125 from liner tube 121 using a special driver 501. The driver 501 can turn the internal shaft 125 inside the liner tube 121 such that the locks connecting the internal shaft 125 to the inner walls of the liner tube 121 can be opened and the internal shaft 125 can be removed from the liner tube 121 as shown in step 103. FIG. 6 illustrates removal of the internal shaft 125 from the liner tube, using a mechanical excavator 301.

At step 105*a*, a grooved pipe 127 is inserted inside the liner tube 121. The groove pipe 127 can provide a drainage well for removing the groundwater. The grooved pipe 127 can be made from hard plastic or hard polymer, for example, polyethylene, polyvinyl chloride (PVC), hard un-plasticized polyvinyl chloride (UPVC), or similar material. The grooved pipe 127 can be wrapped with a layer of geotextile (e.g., permeable fabric which, when used in association with soil, has the ability to separate, filter, reinforce, protect, or drain). The geotextile layer can filter groundwater that penetrates into the grooved pipe. As a result occurrence of piping phenomena which includes removal of soil while removing the groundwater can be prevented.

Figure 7:
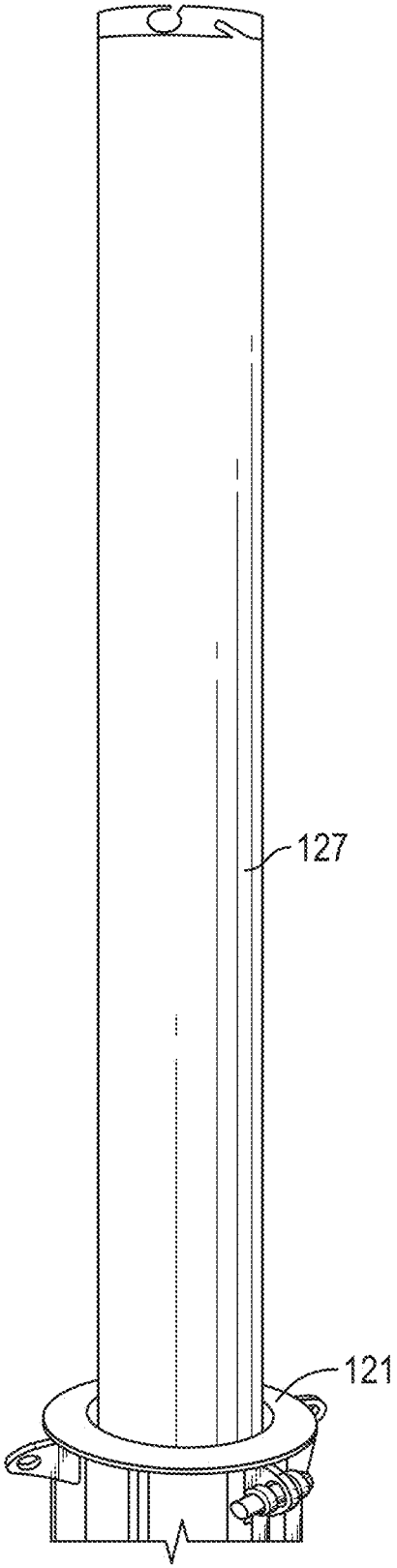
FIG. 7 illustrates installation of a grooved pipe inside the liner tube, according to an implementation.
Figure 8:
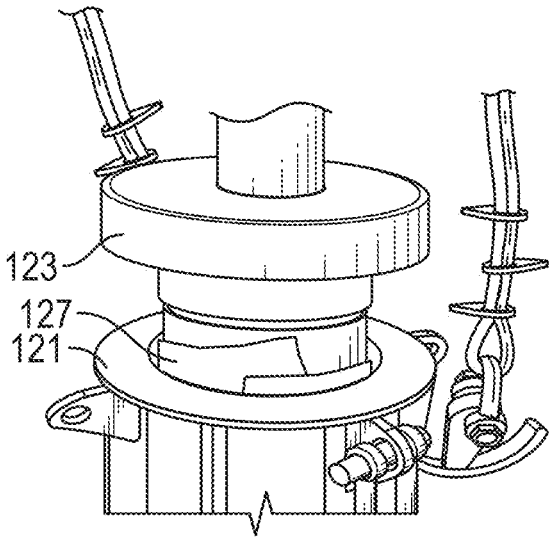
FIG. 8 illustrates a grooved pipe hammered inside the liner tube using a mechanical hammer, according to an implementation.

The grooved pipe 127 can have a diameter such that upon wrapping the grooved pipe 127 with the geotextile layer, the total diameter of the grooved pipe 127 is smaller than the inner diameter of the liner tube 121. As shown in step 105*b*, the geotextile wrapped grooved pipe 127 can be installed inside the liner tube 121. FIG. 7 illustrates installation of the grooved pipe 127 inside the liner tube 121. FIG. 8 illustrates a grooved pipe 127 hammered inside the liner tube 121 using a mechanical hammer 123, according to an implementation.

At step 107, the bottom of grooved pipe 127 is filled with sand to stabilize the grooved pipe 127. For example, the grooved pipe 127 can be filled for around 50 centimeters from the bottom (shown as 129 in FIG. 1). Filling the grooved pipe with sand makes the pipe heavy such that the grooved pipe 127 does not move with movements of the liner tube 121. The sand filling 129 can also prevent occurrence of piping phenomena caused by removal of the soil when the groundwater is removed.

Figure 9:
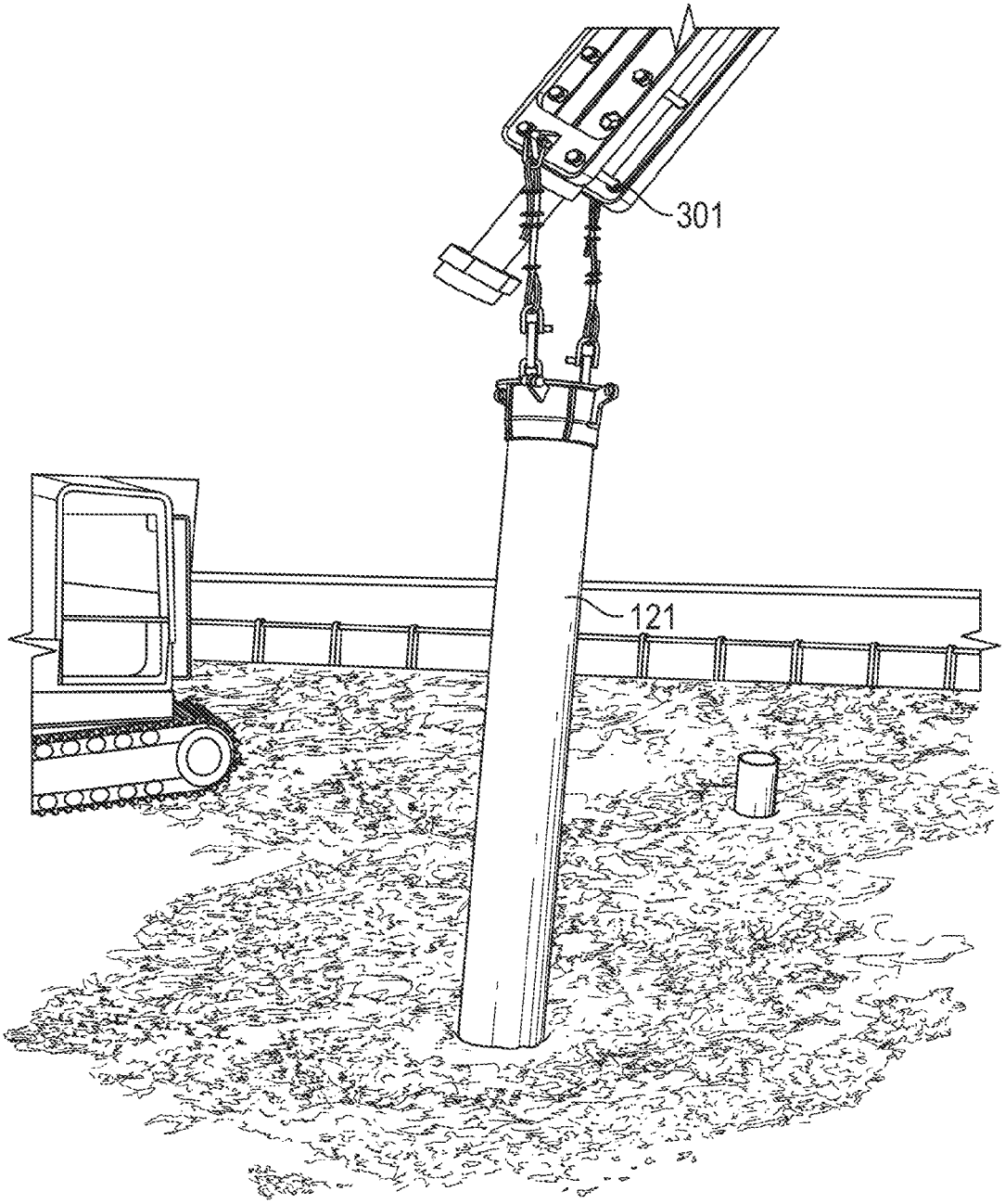
FIG. 9 illustrates removal of the liner tube using a mechanical excavator, according to an implementation.
Figure 10:
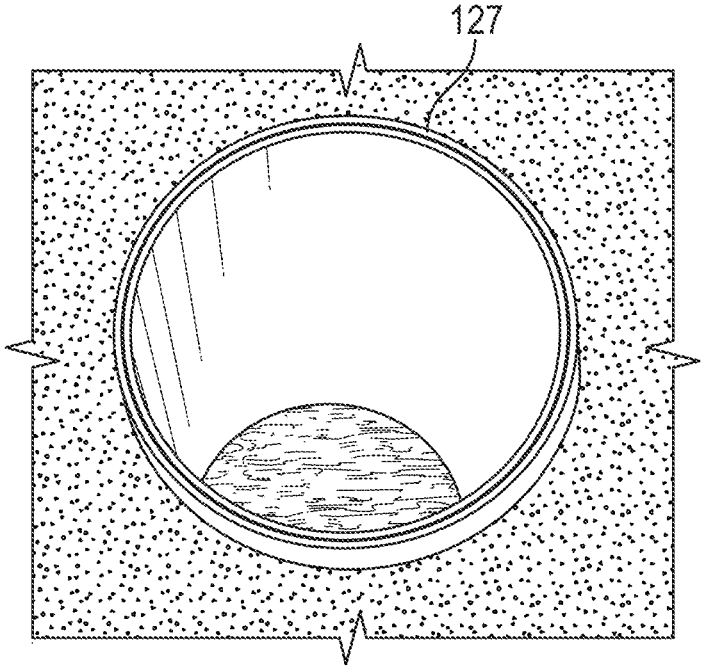
FIG. 10 illustrates filling of the gap between the grooved pipe and the soil using sand, according to an implementation.

At step 109, the liner tube 121 can be removed from the ground, for example, by a mechanical excavator 301, as shown in FIG. 9, such that the grooved pipe 127 remains in the ground on its own. Upon removal of the liner tube 121, the soil around the groove pipe 127 may slip and collapse such that a loose layer of soil is created around the grooved pipe 127. To reduce this possibility or prevent this, the remaining space between the grooved pipe 127 and the soil around it can be filled with sand as shown in step 111 and in FIG. 10.

Figure 11:
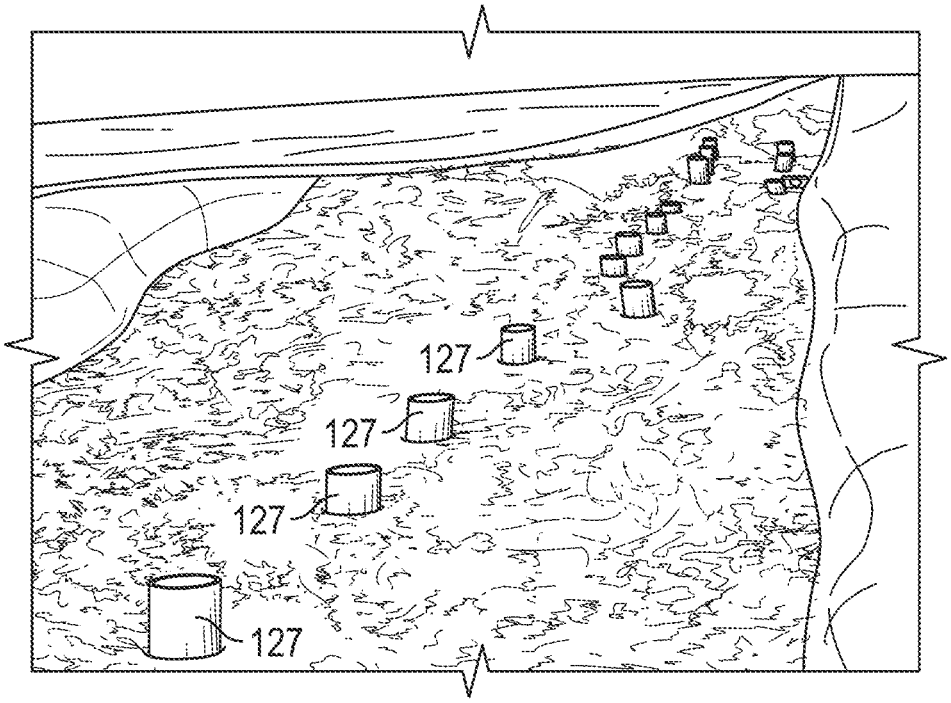
FIG. 11 illustrates multiple drainage wells installed throughout the land, according to an implementation.

FIG. 11 illustrates multiple drainage wells installed throughout the land, according to an implementation. Although only the grooved pipe is shown, the process of making the multiple drainage wells may be the same as the process of making a single drainage well as described with respect to FIG. 1. As also shown in FIG. 2 (201) multiple grooved pipes 127 can be installed with predetermined distances throughout a land prior to start of construction activities. Upon installation of the groove pipes such that the groove pipes create drainage wells, piping and installation of drainage pumps for removal of the drained water can be performed. Step 111 of FIG. 1 illustrates water drainage pumps installed to drain water from the grooved pipes 127.

Figure 12:
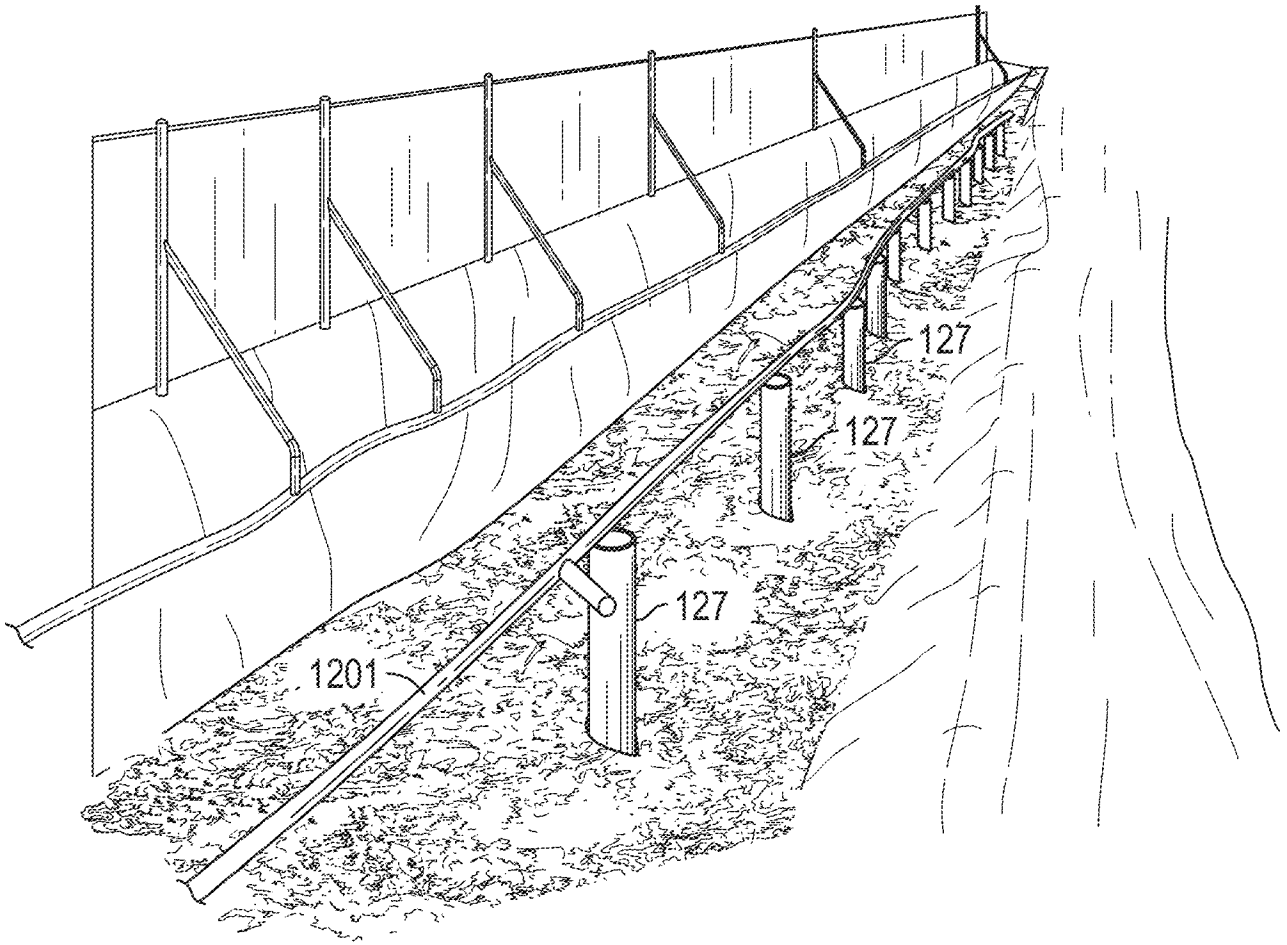
FIG. 12 illustrates a network of multiple connected drainage wells and stepwise excavation, according to an implementation.

FIG. 12 illustrates a network of multiple connected drainage wells and stepwise excavation, according to an implementation. As shown in FIG. 12, the network of grooved pipes 127 can be installed in the land and connected to each other via pipes 1201 for drainage. The excavation can be done stepwise such that, for example, the area with grooved pipes 127 in FIG. 12 has been excavated while the surrounding areas have not yet being excavated.

Figure 13:
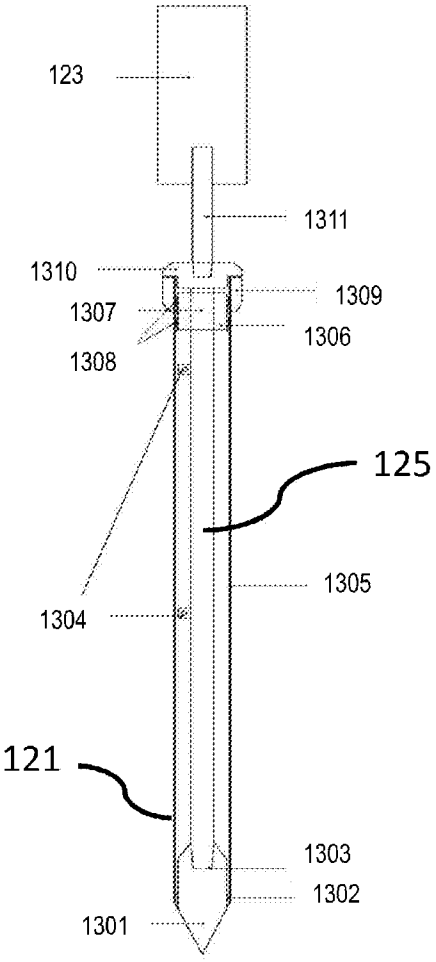
FIG. 13 illustrates various parts of a liner tube, according to an implementation.

FIG. 13 illustrates various parts of a shuttle system (e.g., a liner tube 121 having an internal shaft 125), according to an implementation. The liner tube 121 includes an outer wall 1305 and an internal shaft 125. The internal shaft 125 is placed within the outer wall 1305. The outer wall 1305 may be a cylindrical shape with both ends of the cylinder being open. The internal shaft 125 is placed within the cylindrical shaped outer wall 1305. The internal shaft 125 includes a body and a cone shaped head 1301 connected to one end 1303 of the body. The cone shaped head 1301 extends outwardly from the bottom of the outer wall 1305. The liner tube 121 also includes a steel rim 1302 that tightens the outer wall 1305 at its bottom end to the cone shaped head 1301 to facilitate penetration of the liner tube 121 into the soil. The internal shaft 125 also includes hooks 1304 configured for transporting the internal shaft 125.

A cylinder 1306 can be attached to the other end 1307 of the internal shaft 125. The other end 1307 may be a solid part of the internal shaft 125 made from steel and may configured to engage with the cylinder 1306 via a screwing mechanism although other form of engagements are contemplated. The cylinder 1306 may be configured to facilitate load transfer between the liner tube 121 wall and the internal shaft 125. The outer surface of the cylinder 1306 may be covered by the rings 1308 to enable coupling between the internal shaft 125 and the outer wall 1305. Alternatively, the rings 1308 may enable coupling between the internal shaft 125 and the mechanical excavator. To this end, hardening components 1309 similar to steel rims 1302 made from steel plates can be installed around the top part of the liner tube 121. The hardening components 1309 may be configured to protect the liner tube 121 from being damaged due to connection between the mechanical excavator and the internal shaft 125 and hammering and to facilitate removal of the internal shaft 125 from the liner tube 121. Component 1310 is a flat pounding head connected to a hydraulic hammer 123 for transferring the force from the hydraulic hammer 123 to the liner tube 121 and the internal shaft 125. The short steel shaft 1311 connects the hydraulic hammer 123 to the flat pounding head 1310 and transfers the force from the hydraulic hammer to the flat head.

Figure 14:
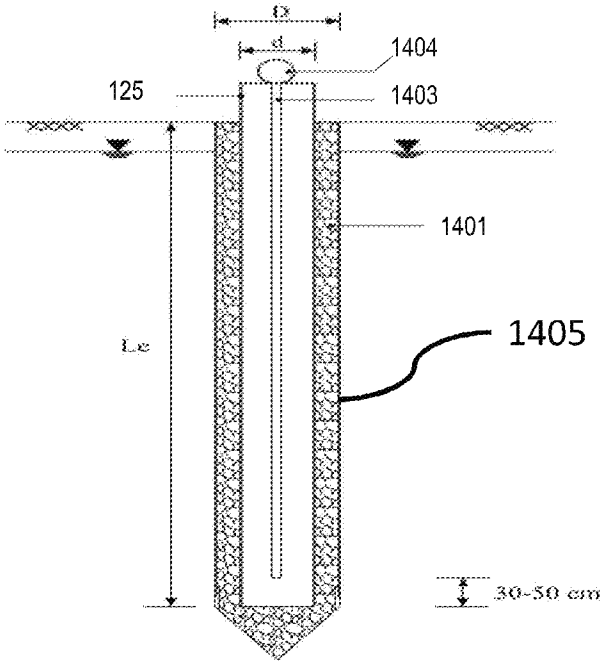
FIG. 14 illustrates vertical sectional view of a drainage well upon removal of the liner tube and insertion of grooved pipe, according to an implementation.

FIG. 14 illustrates vertical sectional view of a drainage well upon removal of the liner tube 121 and insertion of grooved pipe 127, according to an implementation. The drainage well 1405 is formed upon removal of the liner tube 121 (not shown in FIG. 14). The space previously occupied by the liner tube 121 is filled with sand and collapsed loose soil shown as 1401. The grooved pipe 127 wrapped in geotextile wrapping is standing in the middle of the drainage well 1405. The length of the grooved pipe 127 is longer than the liner tube 121 such that part of the grooved pipe 127 can be exposed outside the drainage well 1405. A pipe 1403 can be placed inside the grooved pipe 127 to remove the groundwater collected inside the grooved pipe 127. The pipe 1403 can be a plastic pipe connected to a drainage pump (not shown). The pipe 1403 can be connected to a main pipe 1404 (similar to pipe 1201 shown in FIG. 12) to drain groundwater from the network of the drainage wells, as shown in FIG. 14.

Figure 15:
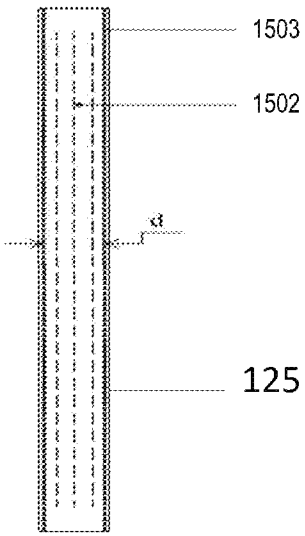
FIG. 15 illustrates vertical sectional view of the grooved plastic pipe with a geotextile wrapping, according to an implementation.

FIG. 15 illustrates vertical sectional view of the grooved plastic pipe 127 with a geotextile wrapping, according to an implementation. The grooved pipe 127 is wrapped with a layer 1503 of the geotextile that can filter and drain water. Moreover the grooves (slits) 1502 on the surface of the grooved pipe 127 allow the groundwater to enter the grooved pipe such that the water can be removed by the pipe 1403 shown in FIG. 14.

Figure 16:
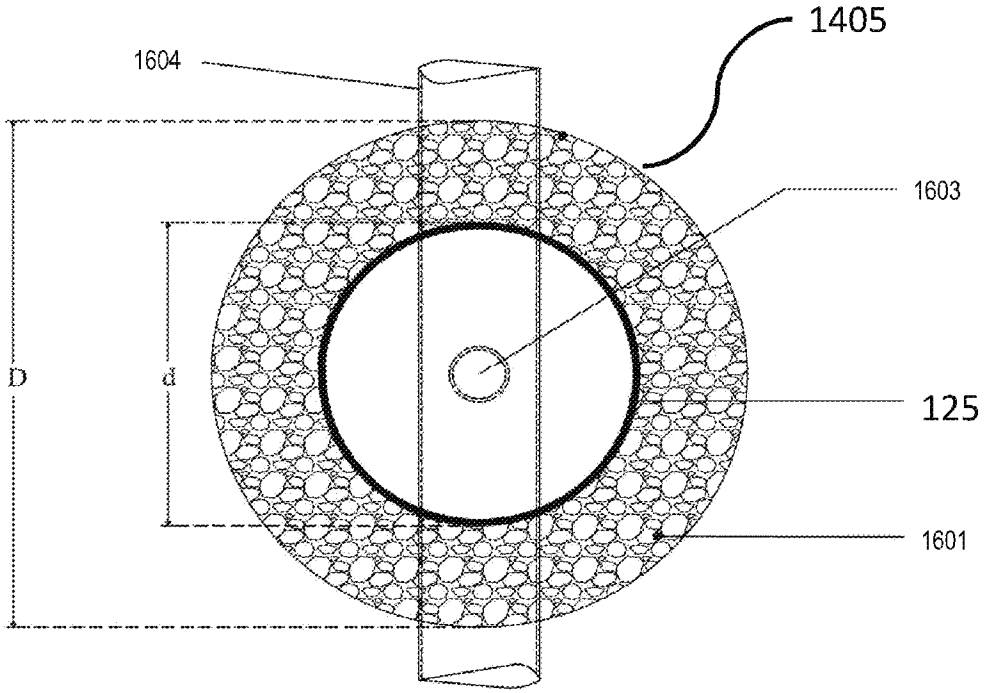
FIG. 16 illustrates a horizontal sectional view of a drainage well, according to an implementation.

FIG. 16 illustrates a horizontal sectional view of a drainage well, according to an implementation. The drainage well 1405 is formed upon removal of the liner tube 121 (not shown in FIG. 16). The space previously occupied by the liner tube 121 is filled with sand and collapsed loose soil shown as 1601 (similar to 1401 in FIG. 14). The grooved pipe 127 wrapped in geotextile wrapping is standing in the middle of the drainage well 1405. A pipe 1603 (similar to pipe 1403 of FIG. 14) can be placed inside the grooved pipe 127 to remove the groundwater collected inside the grooved pipe 127. The pipe 1603 can be a plastic pipe connected to a drainage pump (not shown). The pipe 1603 can be connected to a main pipe 1604 (similar to pipe 1201 shown in FIGS. 12 and 1404 shown in FIG. 14) to drain groundwater from a network of connected drainage wells.

The disclosed method provides various advantages such as, for example, lowering groundwater level in the excavation area having loose granular and collapsible formation through a network of temporary drainage wells; construction of drainage wells in loose granular and collapsible soil by using a shuttle system (e.g., liner tubes with internal shafts) without drilling, removing and transportation of soil; protection of the environment and the workplace; possibility of preforming the groundwater removal with high speed and quality and low cost; taking advantages of the drainage system (the network of drainage wells) for excavation areas in loose granular and collapsible formations to a depth of 7 meters; maintaining safety of upstream areas and preventing damage to adjacent buildings; and not needing large amounts of drainage materials around the drainage wells. The diameter of each drainage well can be around 50 centimeters.

The disclosed method for installation of drainage wells can be used in building sites prior to excavation. For example, for buildings that include underground structures, the disclosed method can be used for removing the ground water or building a sewage system. The method can also be used for sewage drainage ponds and pumping sewage water. The method can also be used in building liquid storage tanks, building roads and related structures and various other construction projects. The method can also be used in farmlands for irrigation purposes.

While the foregoing has described what are considered to be the best mode and/or other examples of providing temporary drainage wells for loose granular soils, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "a" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus the following claims are hereby incorporated into the Detailed Description, with each claim standing on its own as a separately claimed subject matter.

What is claimed is:

1. A method for draining groundwater from an area having loose granular soil, the method comprising:

creating a plurality of drainage wells in the area of the loose granular soil, wherein the drainage wells have a predefined distance from each other and creating each drainage well includes:

hammering, a liner tube with a cone shaped end into the loose granular soil using a mechanical hammer, the liner tube including a housing and an internal shaft placed inside the housing and locked to the housing using a locking mechanism;

unlocking the internal shaft from the housing and removing the unlocked internal shaft from inside the housing subsequent to hammering the liner tube into the loose granular soil;

inserting a grooved pipe inside the housing by hammering the grooved pipe using the mechanical hammer, wherein the grooved pipe is longer than the housing and is configured to receive the groundwater via a plurality of slits within the grooved pipe;

filling bottom of the grooved pipe with sand to stabilize the grooved pipe inside the housing;

removing the housing from the loose granular soil using a mechanical excavator, and filling a space created by the removing of the housing with a filling material;

inserting a drainage pipe inside the grooved pipe of each drainage well from the plurality of drainage wells; and connecting the drainage pipes from the plurality of drainage wells to a pump configured to remove the groundwater penetrated inside the grooved pipes of the plurality of drainage wells.

2. The method of claim 1, wherein removing of the unlocked internal shaft is performed using the mechanical excavator.

3. The method of claim 1, wherein the mechanical hammer is a hydraulic or compressed air hammer.

4. The method of claim 1, wherein the cone shaped end of the liner tube is connected to the internal shaft.

5. The method of claim 1, wherein hammering the liner tube in the loose granular soil is performed without soil removal, and wherein the liner tube compresses the loose granular soil when entering the loose granular soil.

6. The method of claim 1, wherein the liner tube is connected to the mechanical hammer via steel cables.

7. The method of claim 1, wherein the cone shaped end of the liner tube is part of the internal shaft and is configured to facilitate penetration of the liner tube into the loose granular soil.

8. The method of claim 1, wherein each drainage well is about 7 meters deep and about 50 centimeters wide.

9. The method of claim 1, wherein a top part and a bottom part of the liner tube are supported with hard steel plates to increase the liner tube strength.

* * * * *